US007192389B2

(12) United States Patent
Allison

(10) Patent No.: US 7,192,389 B2
(45) Date of Patent: Mar. 20, 2007

(54) ADJUSTABLE LOAD DYNAMIC ACTIVE RESISTANCE TRAINING SYSTEM

(76) Inventor: Kasper Allison, 10 A. Oak St., Santa Barbara, CA (US) 93103

( * ) Notice: Subject to any disclaimer, the term of this patent is extended or adjusted under 35 U.S.C. 154(b) by 395 days.

(21) Appl. No.: 10/617,411

(22) Filed: Jul. 11, 2003

(65) Prior Publication Data

US 2006/0063649 A1 Mar. 23, 2006

(51) Int. Cl.
*A63B 21/00* (2006.01)

(52) U.S. Cl. ..... 482/104; 482/108; 482/121

(58) Field of Classification Search ..... 482/104–108, 482/94–104, 72, 54, 93, 99, 101, 121–123, 482/142

See application file for complete search history.

(56) References Cited

U.S. PATENT DOCUMENTS

| | | | | |
|---|---|---|---|---|
| 5,279,530 | A * | 1/1994 | Hess | 482/70 |
| 5,423,730 | A * | 6/1995 | Hirsch | 482/92 |
| 5,542,897 | A * | 8/1996 | Hall | 482/111 |
| 5,827,154 | A * | 10/1998 | Gill | 482/9 |
| 6,561,956 | B1 * | 5/2003 | Allison | 482/94 |

* cited by examiner

*Primary Examiner*—Jerome Donnelly
(74) *Attorney, Agent, or Firm*—William W. Haefliger

(57) ABSTRACT

Adjustable lifting apparatus, comprising, in combination, a base, multiple cords connected to the base, a mover to be moved along a slide path in response to force exertion by the user's arms or legs, a connection or connections between the mover and one or more of the cords.

17 Claims, 3 Drawing Sheets

ADJUSTABLE LOAD DYNAMIC ACTIVE RESISTANCE TRAINING SYSTEM

This invention relates generally to muscular strength enhancement and training, and more particularly to highly advantageous and simple training apparatus, and methods, embodying a number of unusual advantages. U.S. Pat. No. 6,561,956 B1 is incorporated herein by reference.

There is need for an improved machine, or an attachment to an existing machine, having a combination of isotonic weights (i.e. free weights, selectorized weight stack, or body weight, etc.) with a form of progressive resistance (i.e. rubber tubing, elastic cords, springs, etc.) for use in strength training. The machine or attachment to an existing machine as an accessory preferably should embody both of the above resistances. The machine or attachment should allow the user to choose one as the sole resistance, or use both together to get both isotonic and progressive resistance. The machine's resistance should be in direct opposition to the exercisers force of movement creating an isotonic, progressive, or isotonic and progressive resistance.

There is also need for an improved machine or attachment to an existing machine designed to provide a form of resistance that is progressive through out the entire range of motion. One purpose of the machine is to allow the user to work through this range of motion slowly or rapidly and still have the same amount of force to be pushed. The machine should exceed the functions of standard free weight and selectorized machines. Standard machines only possess the isotonic (free weight, selectorized weight, or body weight) forms of resistance which are subject to change with different speeds of movement by the exerciser. The faster the movement the less force is required to move it due to momentum. There is need for a progressive and/or isotonic resistance training system that creates an environment that has a constant amount of weight, regardless of the speed of the movement.

SUMMARY OF THE INVENTION

It is major object of the invention to provide a machine or an attachment to an existing machine as an accessory to meet the above need. The machine allows for a combination of both progressive resistance via rubber tubing, elastic bands, springs, etc. and standard isotonic weights via free weights, selectorized weight stacks, or body weight. The purpose of the machine is to provide a progressive resistance that is constant regardless of the speed of the movement. The resistance in elastic tubing will not provide an overload to the muscle at the beginning of a movement, although it does provide increasing or variable resistance throughout the movement. Conversely, isotonic weights provide resistance and an overload to the muscle at the beginning of a movement, but not later in the movement because of momentum and the corresponding need to slow the weight before coming to the end of the movement. The combination of isotonic weights and the elastic tubing solves the aforementioned problems because the resistance (inertia) of the weight, counters the lack of tension or resistance in the elastic tubing during the initial stages of the movement, and the increasing stretch and resistance of the elastic tubing controls the momentum of the weights and provides the needed additional or compensatory resistance at the end of the range of motion.

Basically, the invention is embodied in apparatus that comprises a) a base, b) multiple cords connected to the base, c) a mover on a slide to be moved along the slide in response to force exertion by the user's arms or legs, and d) a connection or connections between the mover and one or more of the cords.

It is another object of the invention to provide cords individually and selectively having releasable connection to the mover or slider. That connection may have one of the following forms.

i) adjustable pin and socket connections ii) adjustable rings on the cord ends to be adjustably connected to the mover.

Yet another object is to provide a path of slide movement that extends angularly upwardly, the cords extending in directions allowing adjustable attachment to the angularly movement slider. The attachment may be selectively displaced along a second path in a direction generally parallel to the path of slide angular movement.

A further object is to provide apparatus that comprises a) a base b) multiple cords connected to the base, c) a mover to be moved in response to force exertion by the user's arms or legs, d) weights movable with the mover, e) the cords selectively and individually having releasable connections to the mover, said releasable connections including rings connected to the cords, and a first lateral connection on the mover onto which the rings are selectively transferable.

These and other objects and advantages of the invention, as well as the details of an illustrative embodiment, will be more fully understood from the following specification and drawings, in which:

DRAWING DESCRIPTION

DETAILED DESCRIPTION

Figure 1:
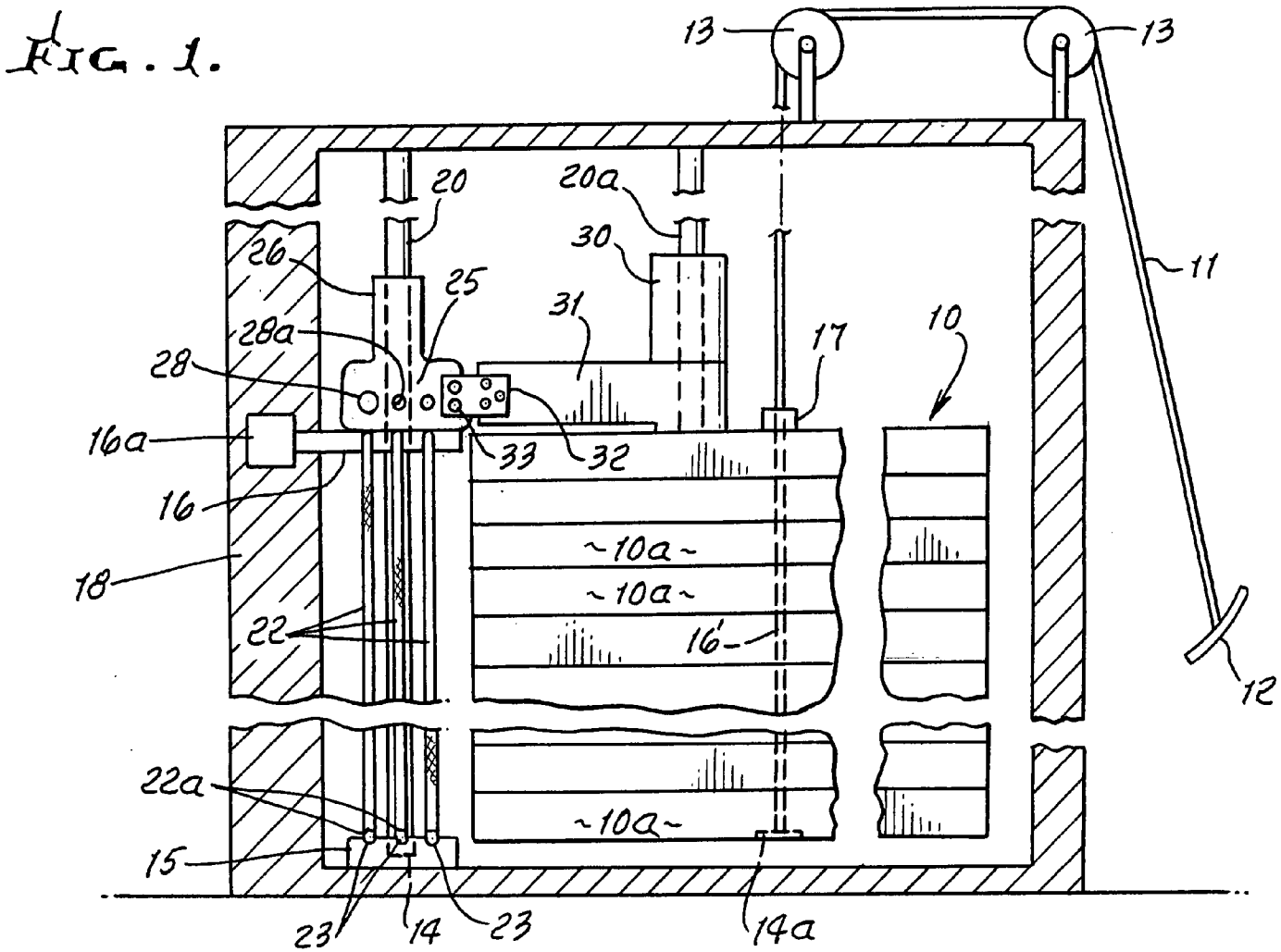
FIG. 1 is an elevation showing one form of apparatus incorporating the invention.

In FIG. 1, a stack 10 of weights ba is adapted to be raised and lowered by a rope or cable 11. A user may grasp and pull at 12 to exert force on the cable, which may pass over rollers 13. The weights extend transversely. A lateral support 14*a* supports the weight stack. A connector 16' extends upwardly from the center of the support, and is joined at 17 to the rope or cable, whereby the weight stack may be centrally raised and lowered via force exertion on the rope or cable.

In accordance with the invention, a guide 20 is supported at 14 and extends upwardly near or adjacent to the weight stack. See also guide 20*a*.

Multiple cords, for example three resiliently stretchable cords 22 have their lower ends 22*a* releasably attached or connected, as by hooks 23 to a horizontal member supported on a base 15, the cords being close to the upright guide 20. A bracket 16 supports the upper ends of the cords, which allows their upward stretching, from the position shown.

The bracket is attached at 16*a* to frame 18.

A mover, such as a slider 25 is slidable vertically on guide 20. A stability cylinder 26 may be employed to guide on 20, and may be attached to, or made integral with the slider 25. Cable 11 is shown as operatively connected to slider 25, to raise and lower the slider. At rest position, the slider seats on cord retention bracket 16. The upper ends of the cords are selectively and releasably attachable to the slider, as by pins 28 that fit in side openings or sockets 28*a* in the slider. If a pin is removed, the corresponding cord is not stretched as the slider moves upwardly, but those cords remaining effectively pin-connected to the slider are resiliently stretched as the slider moves upwardly. As stated, the slider 25 is one form of mover.

A stability cylinder 30 is provided to slide up and down on the guide rail 20*a*. It is rigidly connected to a bracket 31 which projects toward the slider 25. A connecting bracket 32 is attached to 31, and is releasably connectible to the slider 25, as by removable pin connections at 33. If the pins are in place, elements 25, 32, 31 and 30 move upwardly as slider 25 is raised, but if the pins 33 are removed, the slider and the selected cord upper ends do not move upwardly as the weights are lifted. This construction enhances stability, and enables the weights to be raised as the cords are stretched. If no cords are connected to the slider, the weights are raised as the slider is raised. If the pin connections at 33 remain, and one or more cords is connected to the slider, only that cord or those connected cords are stretched as the weights are lifted, to provide reactions to pulling of the cable, as discussed.

When the bracket 32 is released from the slider, the bracket 31 and cylinder 30 are supported on the weight or weights, which are then effectively disconnected from the up and down movement of the slider.

Figure 2:
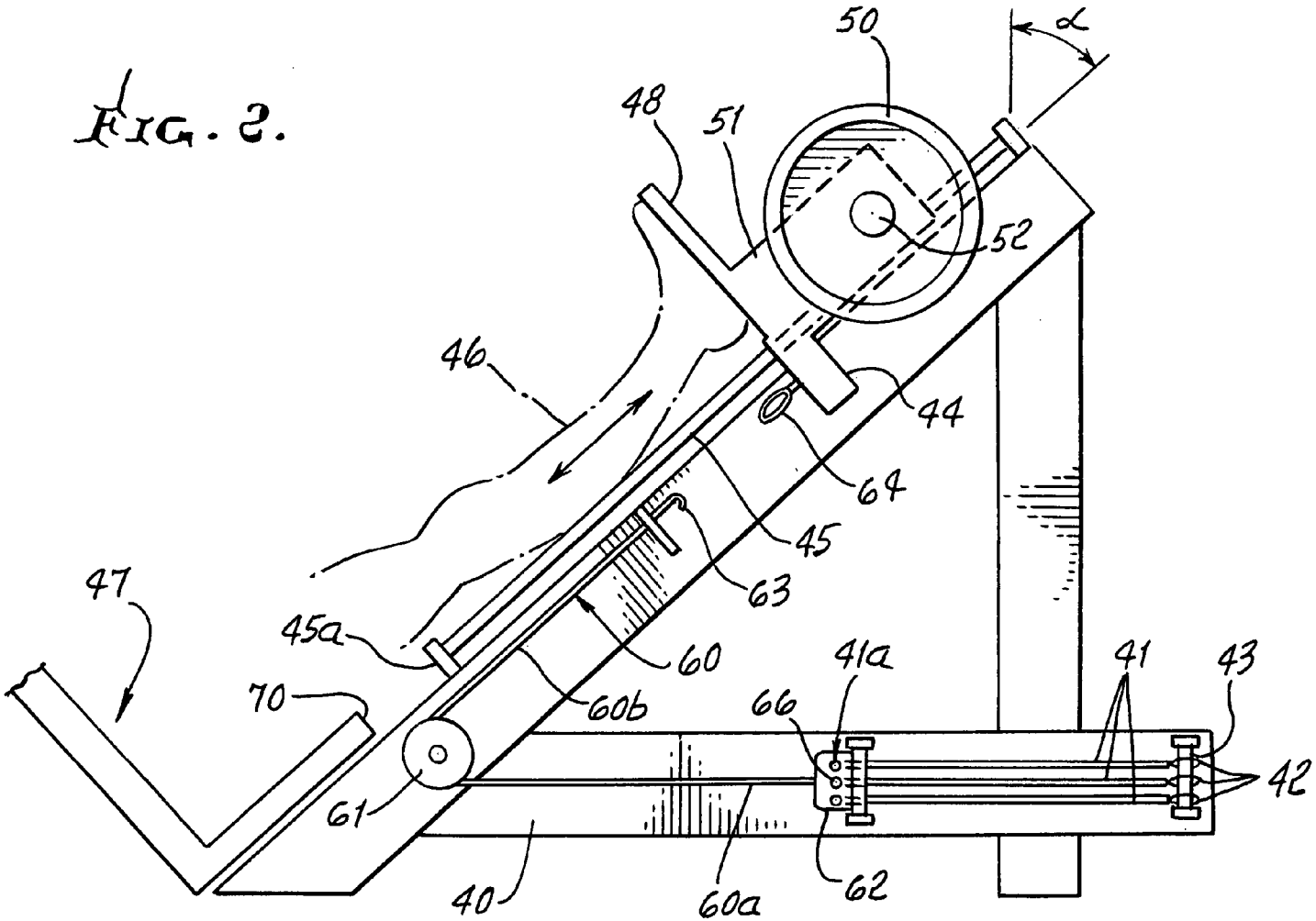
FIG. 2 is an elevation showing another form of apparatus incorporating the invention.

Referring to FIG. 2, a base or frame is shown at 40, and multiple stretchable cords 41 have their ends at 41*a* effectively connected to the base, as via cord end loops 42 and a loop retainer 43.

A mover such as slider 44 is mounted on and movable along a slide or guide rail 45, in response to force exertion by the user's raised legs, seen at 46. The user sits in a cradle 47, and flexes as his legs, to cause his feet to push on pusher 48 attached to or associated with the mover. Slider guide rail 45 extends at an angle $\alpha$ from vertical, where $\alpha$ is preferably between 30° and 75°. A weight 50 may be effectively attached at 51 to the pusher. For example a circular weight 50 may have a central opening to be removably received on a shaft 52 attached to 51.

Multiple cords 41 are effectively attached to mover or slider 44, as via a line 60 entrained over pulley 61, and having a first line section 60*a* attached to the cord end carrier 62, and a second section 60*b* attachable to the mover 44 as via a hook and loop connection, 63 and 64. The cord ends 41*a* are selectively connectible to the carrier 62, via pin and socket connections indicated at 66.

As the pusher and slider are moved upwardly along the guide rail 45, the attached cords are resiliently stretched, from a rest position, this corresponds to engagement of rod 45 end 45*a* with a cradle stop 70. Rod 45 projects from the slider toward that stop.

The FIG. 2 device may be considered as a ramp-type device accommodating to flexing of the user's legs, as against resistance imposed by the cords and weight or weights, (if used). Such weights may be selectively removed off support 52.

Figure 3:
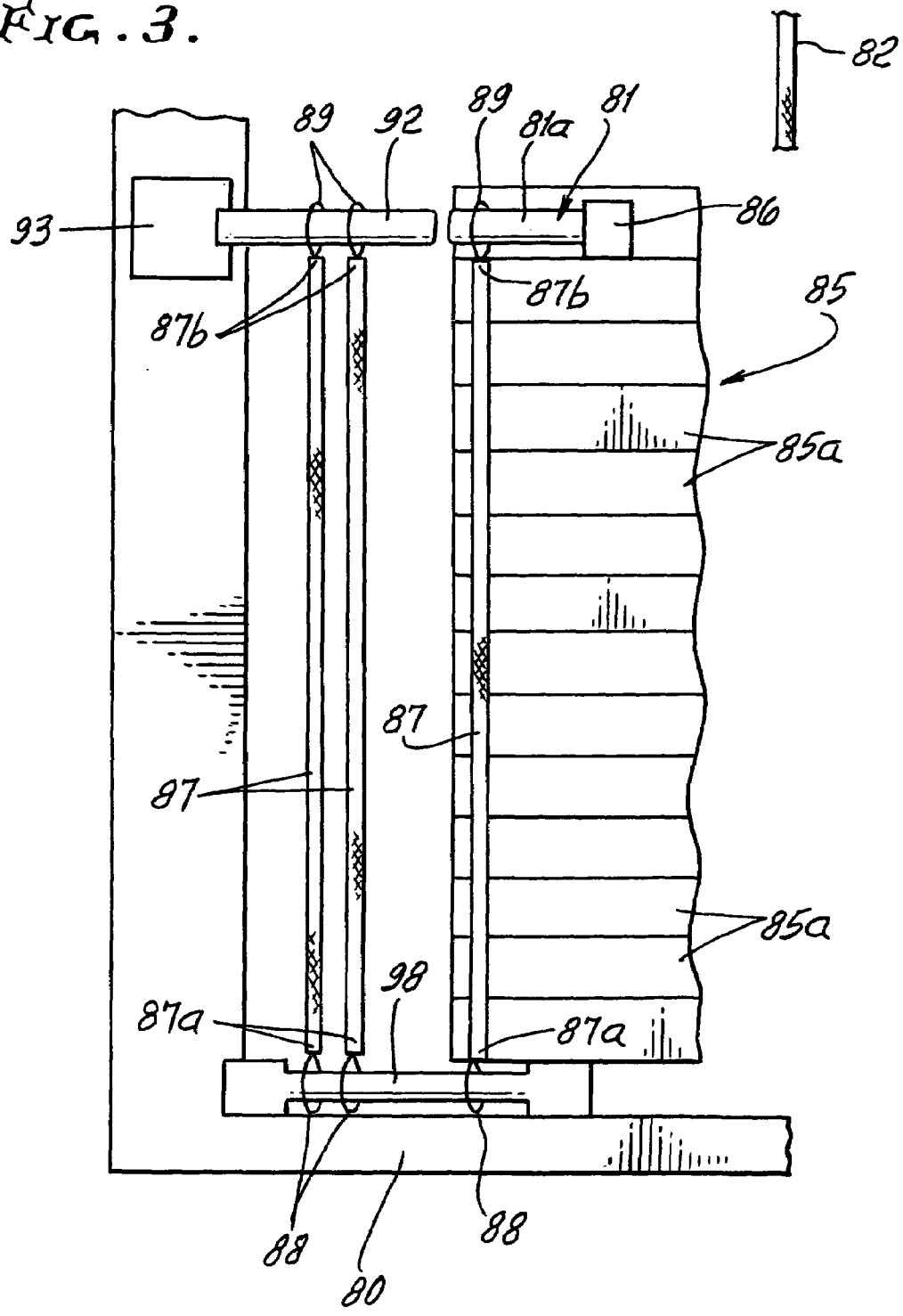
FIG. 3 is an elevation showing yet another form of the invention.

FIG. 3 shows a modified lifting apparatus that include a base 80, and a mover 81 to be moved (for example upwardly) in response to force exertion by a user's arms. For example, the mover may be lifted in response to lifting by a cable 82 extending over pulleys to a handle to be pulled downwardly as in FIG. 1. Weights 85*a* in a stack 85 are movable upwardly with the mover.

Multiple yieldably stretchable cords 87 have lower ends 87*a* connected to the base 80 as via transverse shaft 98 on which cord lower end rings 88 are slidably received. The cord upper ends 87*b* selectively and individually have releasable connection to the mover. Such releasable connections includes rings 89 or similar connections connected to the cord upper ends 87*b*. The rings are selectively transferable onto a first lateral projection 81*a* associated with or carried by the mover 81, whereby when the mover moves upwardly, those cords now being connected to projection 81*a* are stretched upwardly to resist such upward displacement. The mover 81 is shown as carried at 86 by the weight stack. Carrier 86 may be considered as a connector slidable upwardly with the stack 85.

Also provided is a second lateral projection 92 carried by a frame part 93 extending upwardly from the base. That projection 92 stores cord rings not yet transferred laterally onto the first lateral projector. The cord lower ends are fixed to the base to resist lifting. The cords may consist of rubber tubing, or elastic bands. A very simple and easily manipulated means to adjust cord tension is thereby provided.

I claim:

1. Adjustable lifting apparatus, comprising, in combination, a) a base, b) multiple cords retained relative to the base, c) a mover positioned to the moved along a guided path in response to force exertion by the user's arms or legs, d) a connection or connections for operative connection between the mover and one or more of the cords, e) and means whereby one or more of the connections may be relatively shiftably detached from said operative connection between the mover and one or more of the cords.

2. The combination of claim 1 including weights connectible to said mover.

3. The combination of claim 2 including a connector receiving weight imposed by said weights, and having releasable connection to said mover.

4. The combination of claim 2 wherein said cords selectively and individually have releasable connection to said mover.

5. The combination of claim 3 wherein said cords selectively and individually have slidably releasable connection or connections to said mover.

6. The combination of claim 4 wherein said releasable connection or connections includes pin and socket connections of said cords to said mover.

7. The combination of claim 4 wherein said releasable connection or connections include rings connected to said cords, and a lateral projection on said mover onto which said rings are selectively slidably transferable.

8. The combination of claim 1 including a user's foot pusher associated with said mover.

9. The combination of claim 8 including a weight or weights associated with said mover to be pushed in a lifting direction by the pusher.

10. The combination of claim 9 wherein said mover has a first path of movement which extends upwardly, and at an angle from vertical.

11. The combination of claim 10 wherein said angle from vertical is between 30° and 75°.

12. The combination of claim 10 wherein said cords have attachment to slide apparatus, the attachment to be selectively displaced along a second path in a direction generally parallel to said path of movement.

13. The combination of claim 12 wherein said second path of movement is beneath the level of said first path of movement.

14. The combination of claim. 1, wherein f) the cords selectively and individually having releasable connection to the mover, said releasable connections including rings connected to the cords, and a first lateral projection on the mover onto which the rings are selectively transferable.

15. The apparatus of claim 14 including a frame and a second lateral projection carried by the frame for storing cord rings not transferred to the first lateral projection.

16. Adjustable lifting apparatus, comprising, in combination, a) a base, b) multiple cords connected to the base, c) a mover on a slide to the moved along a path in response to force exertion by the user's arms or legs, d) a connection or connections between the mover and one or more of the cords, e) the cords relatively and individually having releasable connection to the mover, said releasable connections including rings connected to the cords, and a first lateral projection on the mover onto which the rings are selectively transferable, f) and including a frame and a second lateral projection carried by the frame for storing cord rings not transferred to the first lateral projection.

17. The combination of claim 1 wherein said e) means includes:

$x_1$) first means associated with the mover to receive a selected connection or connections, $x_2$) second means for shiftably receiving a non-selected connection or connections, apart from the mover.

* * * * *